US008583025B2

(12) United States Patent
Fujii et al.

(10) Patent No.: US 8,583,025 B2
(45) Date of Patent: Nov. 12, 2013

(54) IMAGE FORMING APPARATUS WHICH DECREASES A SHEET TRANSPORTATION SPEED DIFFERENCE BETWEEN A REGISTRATION DEVICE AND A TRANSFER DEVICE

(75) Inventors: Tomohiko Fujii, Hyogo (JP); Tomoya Adachi, Hyogo (JP); Masashi Yamamoto, Hyogo (JP)

(73) Assignee: Ricoh Company, Ltd., Tokyo (JP)

( * ) Notice: Subject to any disclaimer, the term of this patent is extended or adjusted under 35 U.S.C. 154(b) by 331 days.

(21) Appl. No.: 12/929,778

(22) Filed: Feb. 15, 2011

(65) Prior Publication Data

US 2011/0200373 A1 Aug. 18, 2011

(30) Foreign Application Priority Data

Feb. 16, 2010 (JP) ..... 2010-031280

(51) Int. Cl.
*G03G 15/00* (2006.01)

(52) U.S. Cl.
USPC ..... 399/394; 399/388

(58) Field of Classification Search
CPC ..... G03G 15/6558; G03G 15/6561
USPC ..... 399/388, 394, 395, 396; 271/226, 228
See application file for complete search history.

(56) References Cited

U.S. PATENT DOCUMENTS 5,878,321 A * 3/1999 Miyazaki et al. ..... 399/388
6,278,859 B1 8/2001 Nagano
6,676,123 B2 * 1/2004 Sahlmann ..... 271/227
7,428,400 B2 9/2008 Iwakura et al.
7,499,669 B2 3/2009 Adachi et al.
7,596,346 B2 * 9/2009 Kurosu et al. ..... 399/316
7,599,633 B2 10/2009 Inoue et al.
7,636,539 B2 12/2009 Kawasaki et al.
7,702,248 B2 4/2010 Adachi et al.
7,734,235 B2 6/2010 Takehara et al.
7,735,634 B2 6/2010 Miyazaki et al.

(Continued)

FOREIGN PATENT DOCUMENTS

JP 06-080273 A 3/1994
JP 11-268843 10/1999

(Continued)

OTHER PUBLICATIONS

Machine translation of Jp 2008-064891 published on Mar. 21, 2008 to Nakayama et al.*

(Continued)

*Primary Examiner* — Ren Yan
*Assistant Examiner* — Blake A Tankersley
(74) *Attorney, Agent, or Firm* — Harness, Dickey & Pierce, P.L.C.

(57) ABSTRACT

An image forming apparatus includes a transfer material transportation device to transport a transfer material; a transfer device to transfer a toner image to the transfer material transported by the transfer material transportation device; a fusing device, disposed after the transfer device, to fuse a toner image on the transfer material transported by the transfer material transportation device; a registration device, disposed before the transfer device, to feed the transfer material, supplied from a sheet feeder, to the transfer device; and a biasing device, disposed for the registration device, to regulate movement of the registration device to decrease a speed difference between a transfer material transport speed generated by the transfer device and a transfer material transport speed generated by the registration device.

13 Claims, 6 Drawing Sheets

(56) References Cited

U.S. PATENT DOCUMENTS

| | | | | |
|---|---|---|---|---|
| 7,778,573 | B2 | 8/2010 | Yamashita et al. | |
| 7,801,471 | B2 | 9/2010 | Adachi et al. | |
| 2002/0051665 | A1* | 5/2002 | Seto et al. | 399/388 |
| 2006/0210326 | A1 | 9/2006 | Takehara et al. | |
| 2006/0210327 | A1 | 9/2006 | Iwakura et al. | |
| 2006/0257176 | A1 | 11/2006 | Kawasaki et al. | |
| 2007/0110458 | A1 | 5/2007 | Inoue et al. | |
| 2007/0147859 | A1 | 6/2007 | Adachi et al. | |
| 2007/0160396 | A1 | 7/2007 | Adachi et al. | |
| 2008/0152378 | A1 | 6/2008 | Yamashita et al. | |
| 2008/0310893 | A1 | 12/2008 | Adachi et al. | |
| 2009/0014288 | A1 | 1/2009 | Miyazaki et al. | |
| 2009/0016772 | A1 | 1/2009 | Adachi et al. | |
| 2009/0129830 | A1 | 5/2009 | Adachi et al. | |
| 2009/0274485 | A1 | 11/2009 | Adachi et al. | |
| 2010/0092226 | A1* | 4/2010 | Herrmann | 399/388 |

FOREIGN PATENT DOCUMENTS

| | | | |
|---|---|---|---|
| JP | 2004-117686 | A | 4/2004 |
| JP | 4264315 | A | 2/2005 |
| JP | 4568609 | A | 7/2006 |
| JP | 2008-064891 | A | 3/2008 |
| JP | 2009-025611 | | 2/2009 |
| KR | 10-0306064 | | 11/2001 |
| KR | 10-2007-0027848 | | 3/2007 |

OTHER PUBLICATIONS

English language abstract for patent publication No. JP-2005-035784 which corresponds to JP-4264315.

English language abstract for patent publication No. JP-2006-195016 which corresponds to JP-4568609.

* cited by examiner

IMAGE FORMING APPARATUS WHICH DECREASES A SHEET TRANSPORTATION SPEED DIFFERENCE BETWEEN A REGISTRATION DEVICE AND A TRANSFER DEVICE

CROSS-REFERENCE TO RELATED APPLICATIONS

This application claims priority to Japanese Patent Application No. 2010-031280, filed on Feb. 16, 2010 in the Japan Patent Office, which is incorporated by reference herein in its entirety.

BACKGROUND OF THE INVENTION

1. Field of the Invention

The present invention relates to an image forming apparatus using electrophotography to form images, such as a facsimile machine, a printer, and a multi-functional apparatus having several of these functions, and more particularly, to an image forming apparatus having a registration device to feed a transfer material to a transfer device at a given timing.

2. Description of the Background Art

Image forming apparatuses using electrophotography to form images, such as copiers, printers, facsimile machines, and multi-functional apparatuses having several of these functions, have a transportation system or mechanism to transport a transfer material such as a sheet of recording media onto which the image is transferred. In general, the transportation system may be a roller-based transportation system or a belt-based transportation system.

In either the roller-based transportation system or belt-based transportation system, a difference of sheet transport speed may occur between different module units of the image forming apparatus, such as between a registration device and a transfer device, between a transfer device and a fusing device due to tolerance and/or deviation of roller diameter and/or belt thickness, temperature fluctuation, uneven thickness of transfer material, or the like. This difference of sheet transport speed can occur in almost any type of image forming apparatus, from monochrome machines to color machines, tandem-type machines, four cycle machines, and so on.

Conventionally, differences of sheet transport speed among the module units may be reduced by detecting a temperature fluctuation and/or sheet transport speed, and adjusting the sheet transport speed at the fusing device and/or registration device.

The conventional detection and control process may reduce a difference of a sheet transport speed among the module units by changing the sheet transport speed between a registration device and a transfer device, and/or between a transfer device and a fusing device. However, in sheet transportation between the transfer device and the fusing device, problems such as image scratch or toner scattering at a slack side, and color misalignment, jitter, or density fluctuation at a tensioned side, may occur. Further, due to tolerance and/or deviation of roller diameter and temperature fluctuation at the fusing device, the fluctuation in sheet transport speed increases. Further, it may be necessary to cope with different sheet transportation paths for various types of sheets. Finally, controlling the sheet transport speed using detection alone cannot greatly reduce strain on the sheet, stretched taut as it is between a registration device and a transfer device, or between a transfer device and a fusing device.

In a conventional art, speed increasing phenomenon of the transfer material may occur when a grip of the rear edge of transfer material between a photoconductor and a transfer device is released, and a fluctuation or deviation of a transfer position may occur due to the reduction in tension. This problem may be prevented by using a configuration like that disclosed in JP-2004-117686-A.

The image forming apparatus of JP-2004-117686-A includes a transporting condition detector to detect a transporting condition of the rear edge of a transfer material on a transfer material transporting belt and a fusing device disposed downstream in the direction, in which the transfer material is transported (transporting direction) from the transfer material transporting belt, in which the fusing device presses against the transfer material from both front and back sides for transport, and a control unit to control the transport speed of transfer material at the fusing device based a transporting condition of the rear edge of transfer material detected by the transporting condition detector. With such a configuration, as transportation of a transfer material progresses, and a grip force between the photoconductor and the transfer device decreases while a transporting force of the fusing device increases, the transfer material transport speed is reduced by the fusing device.

Further, as disclosed in JP-H06-80273-A, the amount of slack in the transfer material between the photoconductor and the transfer device is detected. Based on a gap between the detected amount of slack and an adequate amount of slack, the fusing line speed necessary to correct the excess amount of slack is computed, by which image scratch and wrinkles on a fused sheet caused by too much slack due to fluctuation in the fusing line speed can be prevented.

The image forming apparatus of JP-H06-80273-A includes a sensor to detect an amount of slack in a transfer sheet, and a control unit to control a rotation speed of a roller or a fusing roller to transport the transfer sheet. A rotation speed control unit is disposed at a shaft end of the transfer sheet transporting roller or fusing roller so that rotation speed control unit rotates with the roller. The rotation speed control unit is divided into two portions in an axial direction, and at least one portion can slide on the shaft. The rotation speed control unit includes a pulley that can change a space of slanted opposing faces of a V-shaped groove, and a V-belt wound around the pulley and driven at a constant speed by a drive source. By changing the spacing between the opposing slanted faces in the V-shaped groove, the rotation speed of roller shaft can be changed. In other words, when the amount of slack in the transfer sheet detected by the sensor exceeds a given acceptable amount of slack, the rotation speed of the transfer sheet transporting roller or the fusing roller is changed by changing a groove width of pulley so that the slack in the transfer sheet can be adjusted closer to the given acceptable amount of slack. The groove width of the pulley is the fixed when the loosening of transfer sheet achieves the adequate amount of slack.

In another configuration disclosed in JP-2006-195016-A, a moving speed of a belt to transport a recording medium can be matched to a recording medium transport speed of a registration roller or fusing roller, and reliably maintained in such matched condition with high precision without requiring enhanced precision-machining of parts.

In the image forming apparatus of JP-2006-195016-A, a value of rotation of driven roller is obtained in advance when at least one of a belt and a registration roller does not contact a recording sheet, and a target rotation driving speed is determined to minimize the difference with the driven roller rotation information value.

In another configuration disclosed in JP-4264315-B, the line speed of transfer belt and the line speed of registration roller are controlled to prevent color misalignment.

In the image forming apparatus of JP-4264315-B, a rotation speed is computed using first to fourth stations of transfer belt drive system. To maintain a moving speed of transfer belt at a desired speed, a feedback control for transfer process is conducted for a transfer-belt drive motor to variably control the transfer-belt drive motor. In such configuration, the transfer-belt drive motor is variably controlled to maintain the moving speed of transfer belt at a desired speed, or the feedback control for transfer process for variable control of the transfer-belt drive motor is not conducted, which can be selected as required.

Another configuration, disclosed in JP-2008-64891-A, is used to reduce uneven transfer or shock jitter to an image on a recording medium when various types of recording media are used.

In the image forming apparatus of JP-2008-64891-A, toner images on photoconductors Y, M, C, K are sequentially transferred on an intermediate transfer belt to form a superimposed toner image, and a pair of registration rollers feed a transfer sheet to a secondary transfer nip, set by the intermediate transfer belt and a secondary transfer roller, at a given timing. Then, after the leading edge of transfer sheet passes through the secondary transfer nip, a recording medium transporting force by the registration rollers is set smaller than a recording medium transporting force by the registration rollers before the transfer sheet passes through the secondary transfer nip.

However, there are problems with the above-described approaches.

In the image forming apparatus of JP-2004-117686-A, a difference of sheet transport speed between the transfer device and the fusing device may not be reduced so much, and thus the problem of strain on the sheet caused by the difference of sheet transport speed may still remain. Furthermore, because the transporting condition control detector and the control unit to control a transport speed are required, the system becomes more complex as a whole. Essentially the same problems of partial but incomplete solution to the problem of strain as well as increased system complexity attend.

In the image forming apparatus of JP-H06-80273-A, a difference of sheet transport speed between the transfer device and the fusing device may be reduced. However, in such apparatus, a detection slack of is conducted and slack may be solved, but a problem of sheet pulling condition (tug of war of sheet pulling) caused by difference of sheet transport speed may still remain. Furthermore, because the detector to detect slack and the control unit to control a transporting speed based on a detected slack are required, a system becomes more complex as a whole.

In the image forming apparatuses of JP-2006-195016-A and JP-4264315-B, a difference of sheet transport speed between the transfer device and the registration device may be reduced to prevent a fluctuation or deviation of transfer position. However, a difference of sheet transport speed among each one of sheets may not be solved, and thereby a problem of sheet pulling condition (tug of war of sheet pulling) caused by difference of sheet transport speed may still remain. Furthermore, the detector to detect rotation of driven roller, the computing unit to compute a relation of rotation of driven roller and a rotation speed for driving based on a detection result of the detector, the control unit to change a rotation driving speed to a target value based on a computation result of the computing unit are required, by which a system becomes more complex as a whole.

In the image forming apparatus of JP-2008-64891-A, the strain on the sheet may be reduced. However, if a transporting force at the registration device is set small after passing the recording sheet through at a transfer nip, a transporting force at the transfer device may need to be set large enough to transport the recording sheet to the fusing device. In this image forming apparatus, sheet transportation failure may occur when thick paper is used as the recording sheet. Further, if a transfer nip pressure is set too great, problems such as spotty blank areas in the image area and skew caused by nip imbalance at the transfer device may occur, and thereby a sheet cannot be transported reliably. As such, in the conventional arts, the sheet transport speed difference between the module units may be decreased by employing detectors, using predetermined values, or the like. However, such configuration may not be so effective to decrease the sheet transport speed difference because such configuration may cause some time lag for feedback operation for line speed correction.

SUMMARY

In one aspect of the present invention, an image forming apparatus is devised. The image forming apparatus includes a transfer material transportation device to transport a transfer material; a transfer device to transfer a toner image to the transfer material transported by the transfer material transportation device; a fusing device, disposed after the transfer device, to fuse a toner image on the transfer material transported by the transfer material transportation device; a registration device, disposed before the transfer device, to feed the transfer material, supplied from a sheet feeder, to the transfer device; and a biasing device, disposed for the registration device, to regulate movement of the registration device to decrease a speed difference between a transfer material transport speed generated by the transfer device and a transfer material transport speed generated by the registration device.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
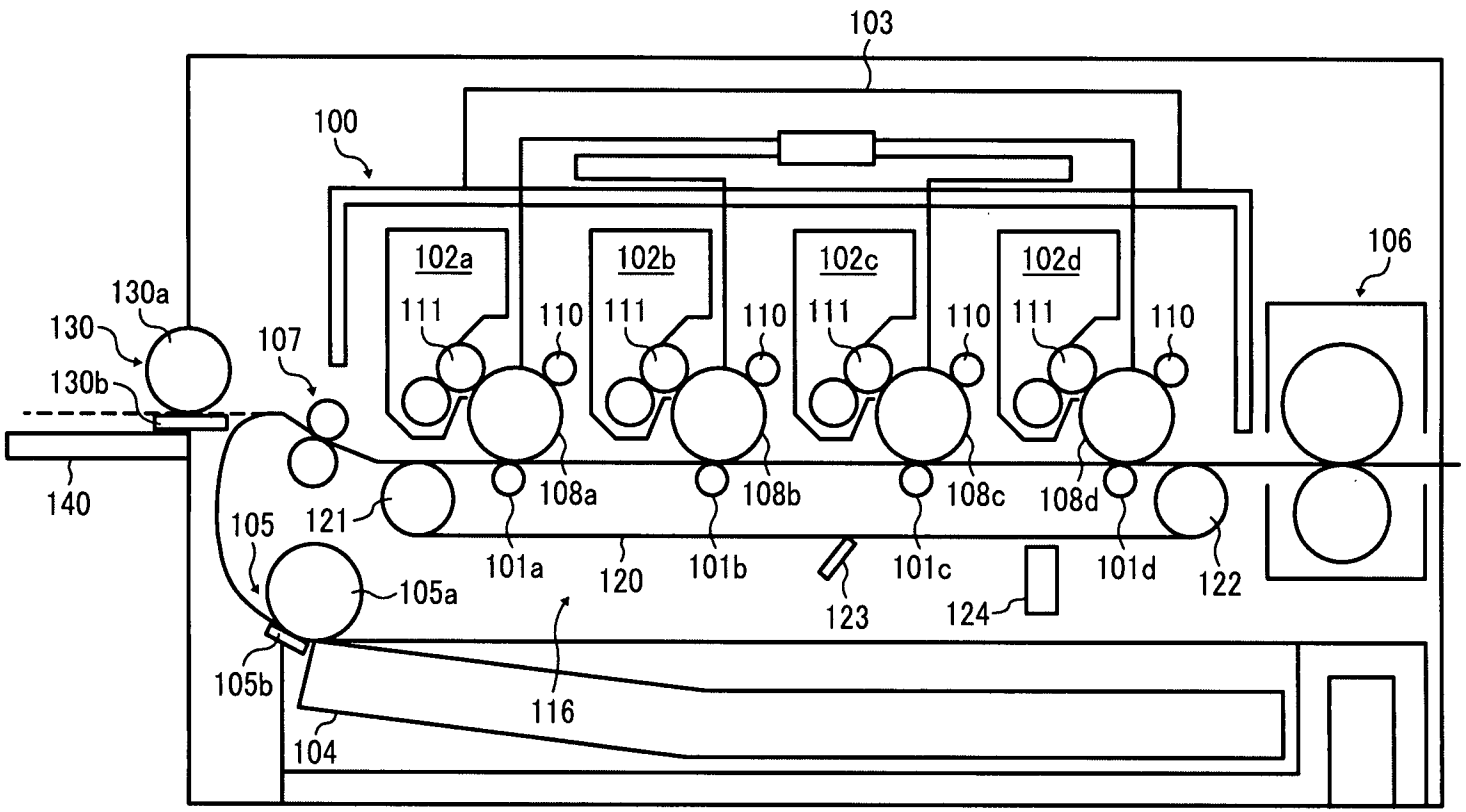
FIG. 1 shows an overall configuration of image forming apparatus according to a first example embodiment.

The accompanying drawings are intended to depict exemplary embodiments of the present invention and should not be interpreted to limit the scope thereof. The accompanying drawings are not to be considered as drawn to scale unless explicitly noted, and identical or similar reference numerals designate identical or similar components throughout the several views.

DETAILED DESCRIPTION OF EXEMPLARY EMBODIMENTS

A description is now given of exemplary embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of the present invention.

In addition, it should be noted that the terminology used herein is for the purpose of describing particular embodiments only and is not intended to be limiting of the present invention. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Furthermore, although in describing views shown in the drawings, specific terminology is employed for the sake of clarity, the present disclosure is not limited to the specific terminology so selected and it is to be understood that each specific element includes all technical equivalents that operate in a similar manner. Referring now to the drawings, image forming apparatuses according to example embodiments are described hereinafter.

First Example Embodiment

FIG. 1 shows an overall configuration of image forming apparatus according to a first example embodiment. Such image forming apparatus may be a color image forming apparatus having generally-used tandem configuration, but not limited thereto. The image forming apparatus may include an image forming unit 100 disposed of process cartridges 102*a*, 102*b*, 102*c*, 102*d* for back, yellow, magenta, cyan image detachably mounted in the image forming unit 100. Further, the image forming unit 100 may include an exposure device 103, transfer rollers 101*a*, 101*b*, 101*c*, 101*d* (hereinafter, may be referred to as transfer roller 101), a sheet feed tray 104, and a fusing device 106.

In the image forming unit 100, each of the process cartridges 102*a*, 102*b*, 102*c*, 102*d* is set at a given position, and photoconductors 108*a*, 108*b*, 108*c*, 108*d* having a drum shape or cylindrical shape (hereinafter, photoconductor 108) may be disposed near each of the process cartridges 102*a*, 102*b*, 102*c*, 102*d*.

The photoconductor 108 can rotate at a given speed, for example, at a line speed of 50 mm/sec, but not limited thereto. Further, a charger 110 having a roll shape can be pressingly contacted against a surface of the photoconductor 108, and the charger 110 may rotate using a rotation of the photoconductor 108. A high voltage power source applies a direct current (DC), or a DC superimposed with alternative current (AC) to the charger 110. With such a configuration, the photoconductor 108 can be uniformly charged and has a uniform surface potential.

Then, an electrostatic latent image is formed on the photoconductor 108 by exposing light, corresponding to image information or data, to the photoconductor 108 using the exposure device 103, used as a latent image forming unit. Such exposure process may be conducted by a laser-beam scanner using a light source such as a laser diode, a light emitting diode (LED), or the like.

Each of the process cartridges 102*a*, 102*b*, 102*c*, 102*d* includes a development unit 111, and the development unit 111 may employ one-component contact type toner. The development unit 111, storing one-component toner, develops the electrostatic latent image on the photoconductor 108 as a toner image using a development bias voltage supplied from a high voltage power source.

The process cartridges 102*a*, 102*b*, 102*c*, 102*d* may be arranged in a tandem manner, and can form a full color image by forming single color images in a given order such as from black, yellow, magenta, cyan. The transfer roller 101 disposed opposite the photoconductor 108 is supplied with a given transfer bias (e.g., +400 V to +2500 V) from a high voltage power source to form a transfer electric field. Then, toner images on the photoconductors 108 are sequentially transferred to a transfer material 115 such as a sheet to form a full color image.

Then, the toner images are fused on a sheet by applying heat and pressure in the fusing device 106, and then ejected. Further, toner remaining on the photoconductor 108 after a transfer process is recovered by a cleaning device and discarded. Further, such cleaning device may not be disposed for the photoconductor 108, but a cleaner-less method can be used to recover toner remaining after a transfer process by using a development unit. Various types of known cleaning devices and/or methods can be employed for example embodiments.

Sheets used as the transfer material 115 stored in the sheet feed tray 104 or a manual feed tray 140 is transported to a registration device 107 using a sheet feed roller 105*a* or a manual sheet feed roller 130*a*. The registration device 107 includes a pair of registration rollers 107*a* and 107*b*. The sheet is fed to a transfer device 116 at a timing that the leading edge of toner image on the photoconductor 108 comes to the transfer device 116. Specifically, a sheet feeder 105 may include a sheet transporter such as a sheet feed roller 105*a* and a separation pad 105*b*. Further, a manual sheet feeder 130 may include a manual sheet feed roller 130*a* and a separation pad 130*b*.

In the transfer device 116, a transfer material transporting belt 120 is extended by a drive roller 122, a tension roller 121, and the transfer roller 101, and can be rotated in a given direction by driving the drive roller 122 using a drive motor. The transfer material transporting belt 120 may be referred to as transporting belt 120, hereinafter.

Further, the tension roller 121 may be provided with an elastic member such a spring at its both axial ends, and the tension roller 121 may be pressed toward the transporting belt 120 using a force of the spring. The tension roller 121 may be made of a metal roller such as an aluminum roll or pipe having a given diameter and length such as for example a diameter of 19 mm and a length of 231 mm. A flange is fit with pressure at the both end of roller, and the flange may be used as a regulation member to regulate deformation of the transporting belt 120.

The drive roller 122 may be, for example, a polyurethane rubber roller (thickness: 0.3 mm to 1 mm), a thin layer coating roller (thickness: 0.03 mm to 0.1 mm), or the like. In example embodiments, a urethane-coating roller (thickness: 0.05 mm, diameter 19 mm), is used as the drive roller 122, in which a diameter of roller may not change so much even if temperature changes or fluctuates.

The transfer roller 101 may be a conductive sponge roller, a conductive solid roller, or the like. The conductive sponge roller may include a metal core and an elastic member coated on the metal core. For example, the metal core may be made of stainless (SUS), and the elastic member has a given resistance value adjusted such as $10^4\Omega$ to $10^{13}\Omega$ by adding conductive material. Such conductive transfer roller 101 may be an ion conductive roller (e.g., urethane+dispersed carbon, nitril-butadiene rubber (NBR), hydrin), an electronic conductive roller such as ethylene propylene diene monomer (EPDM), or the like, and have a given hardness such as Asker-C hardness of 35 degrees to 60 degrees. The transfer roller 101 transfers a toner image from the photoconductor 108 toward the transporting belt 120.

A toner mark sensor 124 and a cleaning blade 123 may be disposed near the transporting belt 120. The toner mark sensor 124 may include a regular reflection sensor and an irregular reflection sensor to measure information of toner image such as toner image concentration and toner image position of each of colors formed on the transporting belt 120 to adjust image concentration and/or color balance. The cleaning blade 123 removes or scrapes toner on the transporting belt 120 to clean the transporting belt 120. The cleaning blade 123 may be made of rubber having a given thickness. For example, the cleaning blade 123 is made of urethane rubber having a thickness of from 1.5 mm to 3 mm and a hardness of from 65 degrees to 80 degrees, and contacts the transporting belt 120 with a counter contact direction.

Toner remaining on the transporting belt 120 after a transfer process is scraped and then recovered to a waste toner container via a toner transportation route. At a cleaning nip between the transporting belt 120 and the cleaning blade 123, an edge of the cleaning blade 123 may be coated with a coating agent such as lubricant, toner, zinc stearate, or the like when parts are assembled. With such configuration, a blade curling at the cleaning nip can be prevented, and a dam layer is formed at the cleaning nip to enhance a cleaning performance. Further, each of the rollers extending the transporting belt 120 is supported by side-plates of a transfer belt unit, which is at an each side of the transporting belt 120.

The transporting belt 120 may be made of resin material dispersed with conductive material, and formed as an endless belt made of resin film. For example, resin material may be polyvinylidene difluoride (PVDF), ethylene tetrafluoroethylene (ETFE) copolymer, polyimide (PI), polycarbonate (PC), thermoplastic elastomer (TPE), or the like, and the conductive material may be carbon black, or the like. In example embodiment, TPE having modulus of elasticity in tension of 1000 MPa to 2000 MPa is added with carbon black, and formed as a belt having single layer configuration having a thickness of 90 μm to 160 μm and a width of 230 mm.

Further, a resistance of the transporting belt 120 may be, for example, preferably set to a given range such as volume resistivity of from $10^9$ Ω·cm to $10^{13}$ Ω·cm and a surface resistivity of from $10^{10}$ to $10^{14}\Omega/\square$ at an environment of 23 degrees Celsius and 50% RH (relative humidity), both measured by HirestaUP MCP-HT450 of Mitsubishi Chemical Corporation by applying a voltage of 500V, and an applied-time of 10 seconds.

If the volume resistivity and surface resistivity of the transporting belt 120 exceeds such range, the transporting belt 120 may be charged, and it may be required to set a higher voltage value as the transporting belt 120 goes to the downstream of image forming positions. Therefore, it may be difficult to supply power to a transfer unit using one single power source. This may occur because a charging potential of surface of the transporting belt 120 becomes higher and self-discharge of the transporting belt 120 becomes difficult due to a discharge occurring at a transfer process, and a transfer material separation process. To mitigate such effect, a dis-electrify unit may be provided for the transporting belt 120.

Further, if the volume resistivity and surface resistivity of the transporting belt 120 becomes lower than such range, a charging potential can be decreased faster, and dis-electrify by self-discharge can occur preferably. However, because current flows in a face direction when a transfer process is conducted, a toner layer may not be applied with an effective level of transfer electric field, or toner scattering may occur. Accordingly, the volume resistivity and surface resistivity of the transporting belt 120 may be set in the above range.

Figure 2:
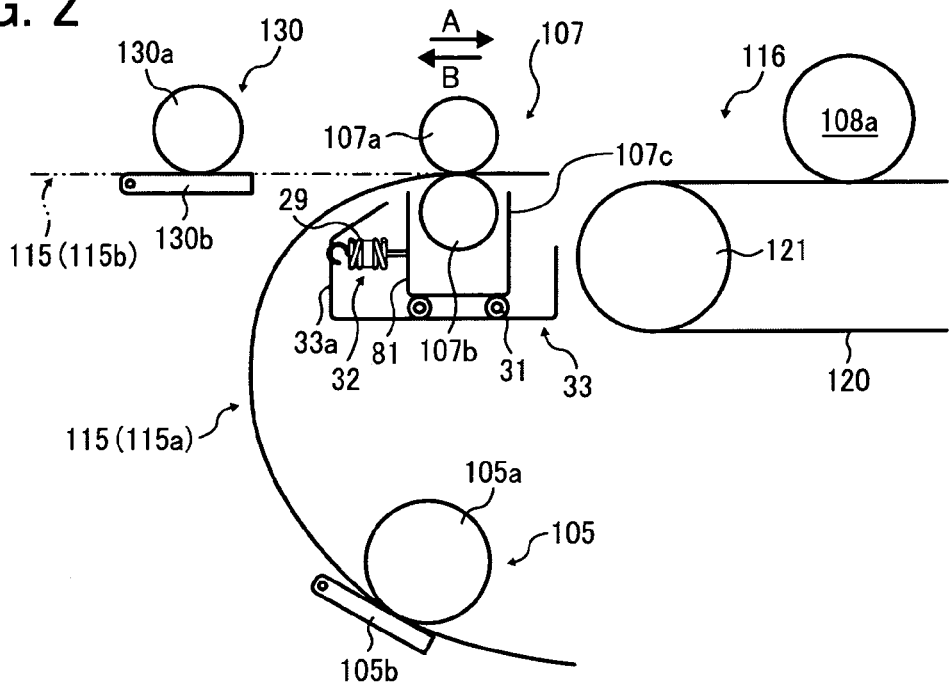
FIG. 2 shows an expanded view of transportation system of image forming apparatus of according to a first example embodiment.

FIG. 2 shows a schematic configuration of the transfer device 116 and the registration device 107 in the image forming apparatus according to the first example embodiment. The registration device 107 may include a pair of registration rollers 107*a* and 107*b* to grip and transport a transfer material 115 such as sheet, paper, film, or the like. The pair of registration rollers 107*a* and 107*b* may be housed and supported in a casing 107*c*.

Further, the casing 107*c* to house the registration rollers 107*a* and 107*b* is provided with a roller 31 at one side such as bottom side of the casing 107*c*, by which the casing 107*c* can be supported by a base plate 33 via the roller 31 as shown in FIG. 2. The registration device 107 can be reciprocally moved in a transport direction of the transfer material 115 as shown by arrows A and B in FIG. 2. Further, instead of the roller 31, a slider that can slide on the base plate 33 can be provided for the casing 107*c*. Such roller or slider may be referred to as a moveable member.

Further, a biasing device 32 may be disposed at an upstream of the registration device 107, which is at an upstream of transport direction of transfer material 115 with respect to the registration device 107. The biasing device 32 may include, for example, a coil spring 29. Specifically, the coil spring 29 is disposed between a side face 33*a* of the base plate 33 and a side face 81 of the casing 107*c*. The biasing device 32 can press the registration device 107 to a downstream of transport direction of transfer material 115 using its elastic biasing force in a direction shown by an arrow A.

In such configuration, followings can be set: a transfer material transport speed by the transporting belt 120*b* is Vt, a transfer material transport speed by the registration rollers 107*a* and 107*b* is Vr, a friction force between the transporting belt 120 and the transfer material 115 is Fbp, a friction force between the transporting belt 120 and the drive roller 122 to drive the transporting belt 120 is Fbd, a friction force between the registration rollers 107*a*/107*b* and the transfer material 115 is Fr, a biasing force of the biasing device 32 is Fs, a force occurring at a moveable member of the registration device 107 is Frm, in which the moveable member is, for example, the roller 31 disposed at the bottom of the casing 107*c* of the registration device 107, and thereby the force Frm is a friction force occurring at the roller 31. In the above described configuration, when a tension Fp occurs for the transfer material 115 due to the speed difference of Vt and Vr, relations of Fbp>Fp, Fbd>Fp, Fr>Fp can be constantly set. Fbp>Fp means that the electrostatic adsorption force (Fbp) between the transfer material 115 and the transporting belt 120 is greater than the tension (Fp) occurring for the transfer material 115. Fbd>Fp means that the grip force (Fbd) of the transporting belt 120 and drive roller 122 is greater than the tension (Fp) occurring for the transfer material 115. Fr>Fp means that the grip force (Fr) of the registration rollers 107*a* and 107*b* is greater than the tension (Fp) occurring for the transfer material 115.

Under such configuration, when a condition of "Fp>Fs+Frm" occurs, the registration device 107 may be moved toward a position in an upstream of transport direction until a condition of "Fp=Fs+Frm" is set. Fp>Fs+Frm means that the tension (Fp) occurring for the transfer material 115 is greater than the force applied to the registration device 107, which is a combined force of the biasing force (Fs) of the biasing device 32 and the friction force (Frm) at the moveable member of the registration device 107. Under the condition of Fp>Fs+Frm, the registration device 107 may be pulled toward the downstream of transportation direction by the tension occurring for the transfer material.

With such movement of the registration device 107, the speed difference between Vt and Vf can be maintained within a given range, and the strain on the transfer material 115 may not occur between the registration device 107 and the transfer device 116, and image quality degradation can be suppressed, in particular, prevented.

As such, when a tension occurs to the transfer material 115, the biasing device 32 can move the registration device 107 in a direction to decrease the transportation speed difference between the registration device 107 and the transfer device 116. With such a configuration, the strain on the transfer material 115 may not occur between the registration device 107 and the transfer device 116, or can be reduced, and thereby color misalignment and jitter on printed image can be reduced. Furthermore, because such configuration can be devised as a purely mechanical configuration, which can omit a detector or a controller, the cost of apparatus can be reduced. The conventional arts may require detectors and a controller such as a software-based control system for adjusting the line speed (i.e., decreasing the line speed difference) between the registration, transferring, and fixing units by preparing a data table in view of the type of sheets (e.g., thickness, weight) and the size of sheets in advance. In the present invention, the line speed difference between the module units can be decreased using the force relationship between the module units, and with such configuration, the transportation of transfer material can be conducted reliably. Further, the transporting belt 120 used as the transfer material transportation device may be an endless belt, and such configuration can reduce cost of apparatus.

Second Example Embodiment

Figure 3:
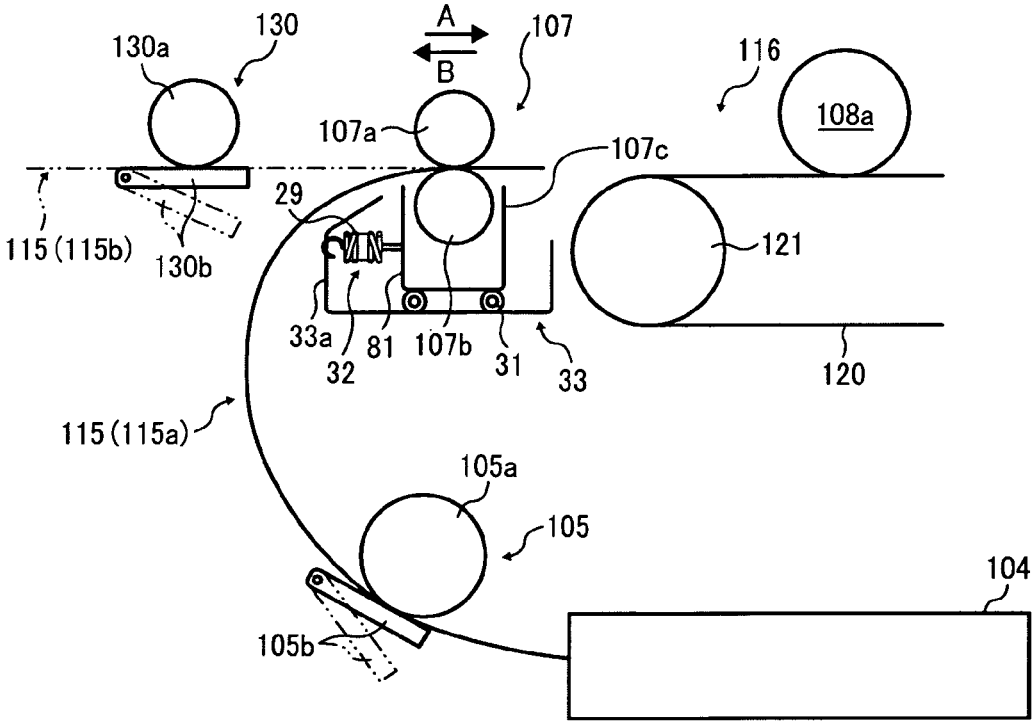
FIG. 3 shows an expanded view of a transportation system of an image forming apparatus according to a second example embodiment.

In FIG. 3, after the transfer material 115 enters the registration device 107, a sheet transportation device or member in the sheet feeder 105 may be set into the disengaged or separated condition from the transfer material 115. Specifically, when the transfer material 115 enters the registration device 107, the separation pad 105*b* may be separated from the sheet feed roller 105*a* as shown by an imaginary line in FIG. 3. Further, in case of the manual sheet feeder 130, the separation pad 130*b* may be separated from the manual sheet feed roller 130*a* as shown by an imaginary line in FIG. 3 when the transfer material 115 enters the registration device 107.

As such, when the transfer material 115 enters the registration device 107, the sheet transportation device or member is separated in the sheet feeder 105, by which the strain on the transfer material 115 may not occur between the registration device 107 and the sheet feeder 105, and image quality degradation due to the strain on the transfer material 115 can be suppressed, in particular, prevented reliably.

Third Example Embodiment

Figure 4:
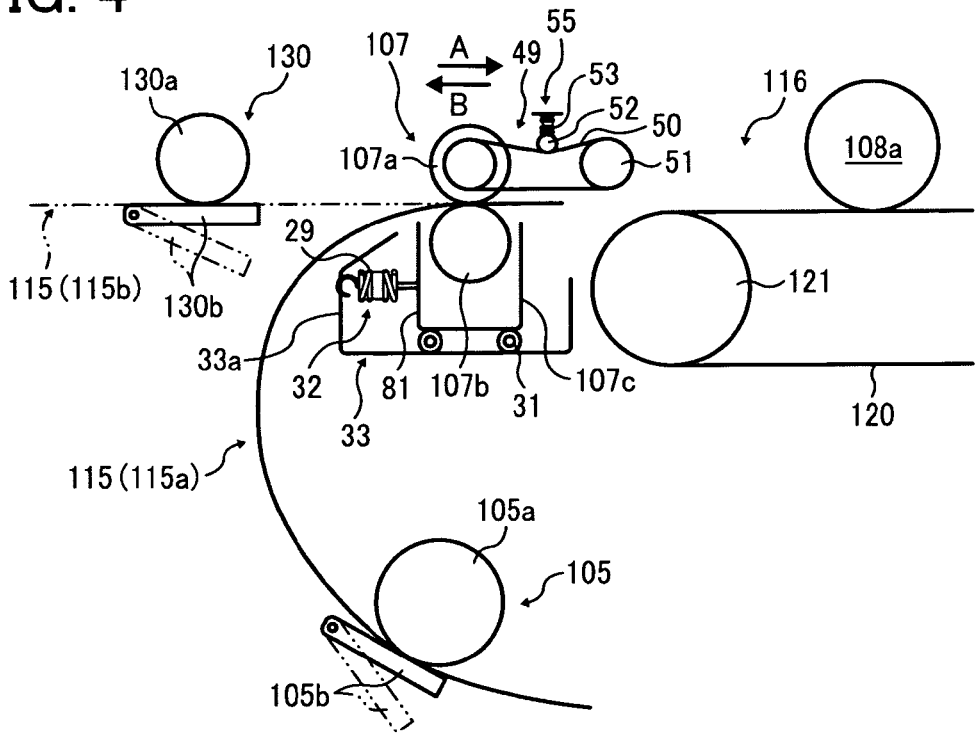
FIG. 4 shows an expanded view of a transportation system of an image forming apparatus according to a third example embodiment.

In FIG. 4, the registration device 107 and a drive unit 49 to drive the registration device 107 may be combined as one integrated unit. Specifically, the drive unit 49 may include an extension roller 51, a drive gear provided for the registration roller 107*a*, and a drive belt 50 extended by the extension roller 51. Further, the drive belt 50 is applied with a tension using a tension application unit 55. The tension application unit 55 may include a tension roller 52 to press the drive belt 50, and an elastic member 53 to press the tension roller 52. With such a configuration, a drive force of the drive belt 50 can be reliably transmitted to the registration device 107, and the transfer material 115 can be fed with a higher precision.

Other configuration shown in FIG. 4 is similar to FIG. 2, and thereby same references are attached for same parts in FIG. 4, and such same parts are not explained. Therefore, as similar the unit shown in FIG. 2, the same effect can be devised for the unit shown in FIG. 4. Furthermore, because the drive unit 49 to drive the registration device 107 can be combined with the registration device 107 as one integrated unit, a simple configuration can be devised and a cost of apparatus can be reduced.

Fourth Example Embodiment

Figure 5:
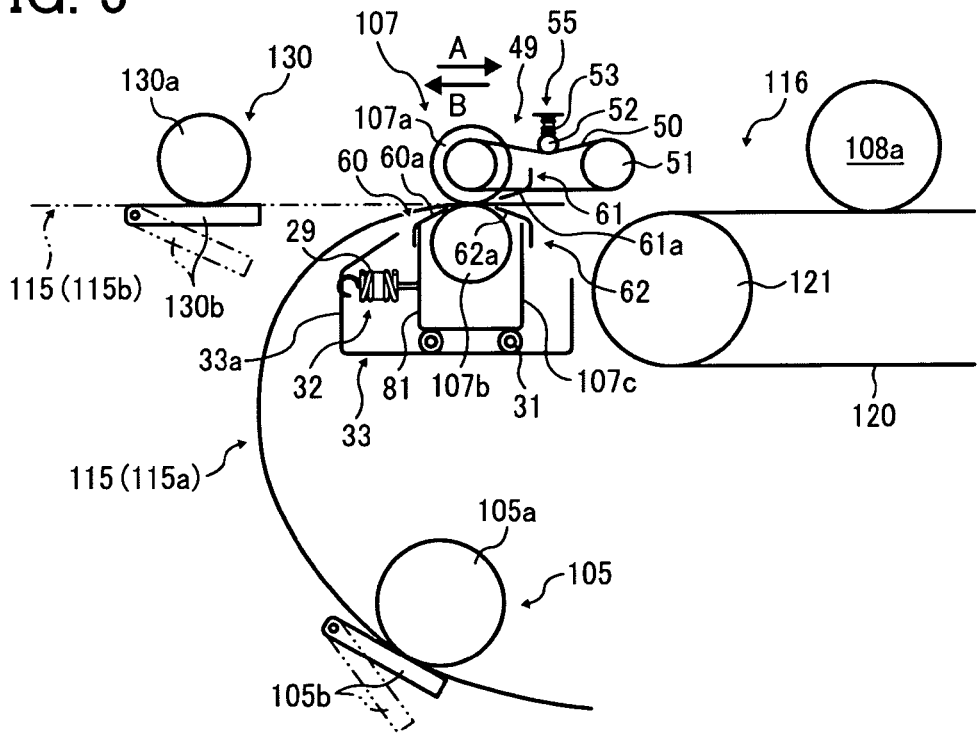
FIG. 5 shows an expanded view of a transportation system of an image forming apparatus according to a fourth example embodiment.

In FIG. 5, in addition to a configuration of FIG. 4, a first transportation assisting unit 60 may be disposed at an upstream of the registration device 107 to assist a transportation of the transfer material 115, and a separator 61 may be disposed at a downstream of the registration device 107 to assist the separation of the transfer material 115 from the registration device 107.

Further, the first transportation assisting unit 60 may include a guide 60*a* such as a plate, disposed and extended from an upstream to a downstream of sheet transportation direction, and the guide 60*a* may approach toward the transfer material 115 from the upstream to the downstream of sheet transportation direction as shown in FIG. 5.

Further, at a downstream from the fusing device 106, a second transportation assisting unit 62 may be disposed opposite the separator 61. The second transportation assisting unit 62 may include a guide 62*a*, disposed and extended from an upstream to a downstream of sheet transportation direction, which may be a plate used to separate the transfer material 115. Further, the transportation assisting units 60 and 62, and the separator 61 may be fixed to the casing 107*c*, by which such units can be integrally moved with the registration device 107.

In such a configuration, because the first transportation assisting unit 60 and the separator 61 are disposed, the transfer material 115 can be reliably fed to the registration device 107, and the transfer material 115 can be reliably fed out from the registration device 107. Therefore, problems such as wrinkles on a fused sheet, scratches on image, sheet jamming in transportation (transportation failure) caused by fluctuation in transportation performance of the transfer material 115, which may occur by moving the registration device 107, can be suppressed, in particular, prevented by controlling a transportation condition of transfer material before and after the fusing nip.

Fifth Example Embodiment

Figure 6:
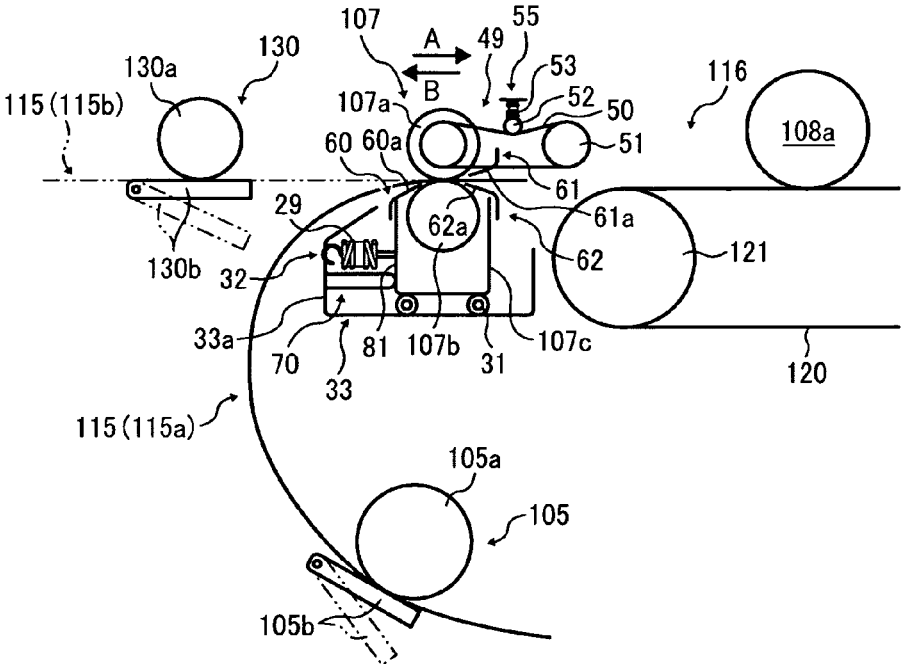
FIG. 6 shows an expanded view of a transportation system of an image forming apparatus according to a fifth example embodiment.

In FIG. 6, a stopper 70 used as regulation member to regulate a movement of the registration device 107 may be disposed in addition to the configuration of FIG. 5. Specifically, the stopper 70 may be provided next to the biasing device 32. For example, the stopper 70 projects from an inner face of the side face 33*a* of the base plate 33, and the leading edge of the stopper 70 can contact an outer face of the side face 81 of the casing 107*c*. With such a configuration, a movement of the registration device 107 toward an upstream of transport direction can be regulated.

In such a configuration, the registration device 107 can be moved to the downstream of transport direction to adjust the transportation speed difference between the registration device 107 and the transfer device 116 within a given range. After the rear edge of the transfer material 115 is separated from the registration device 107, the registration device 107 may be moved to the upstream of transport direction. When the registration device 107 contacts the stopper 70, a movement of the registration device 107 is stopped at a given stop position. Specifically, the stopper 70 can stop the registration device 107 at a default position or a given stop position. With such a configuration, the registration device 107 can be reset to a default condition, and the transportation performance of the transfer material 115 can be enhanced.

Sixth Example Embodiment

Figure 7:
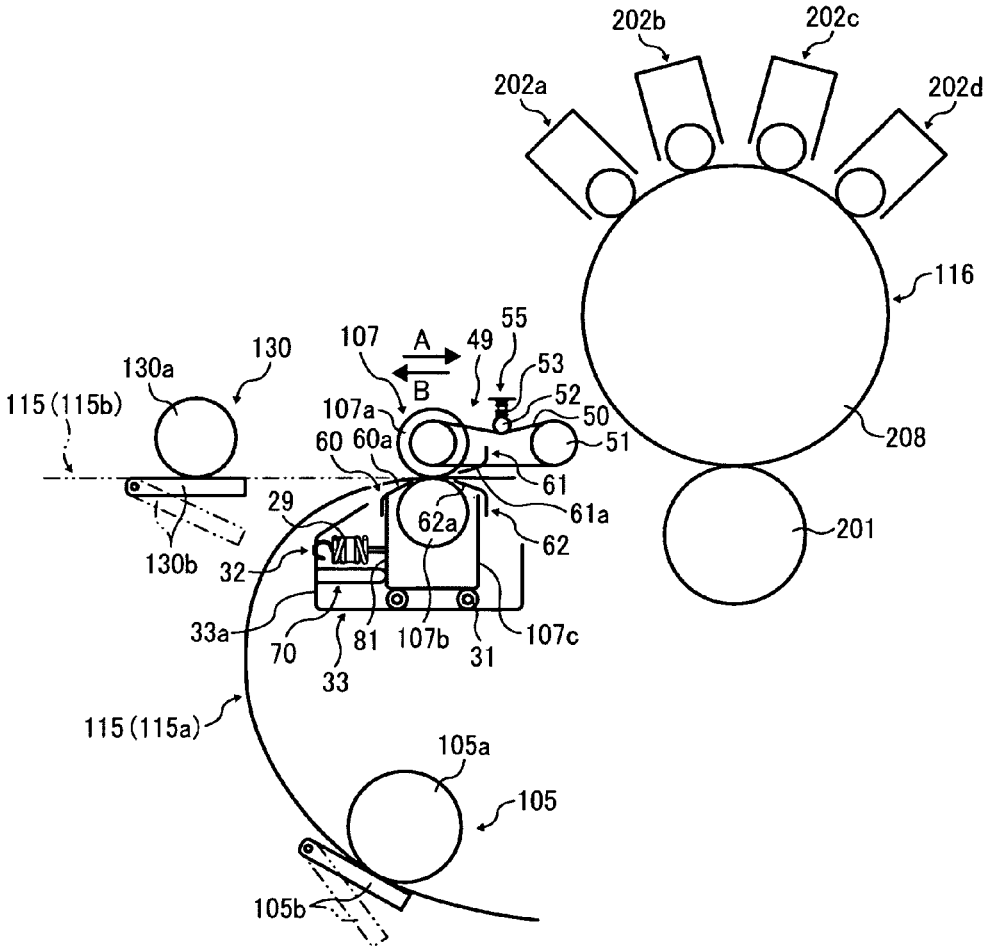
FIG. 7 shows an expanded view of a transportation system of an image forming apparatus according to a sixth example embodiment.

FIG. 7 shows a four-cycle image forming apparatus using the above-described configuration. Specifically, a transfer configuration may include a photoconductor 208 having a drum shape, development units 202*a*, 202*b*, 202*c*, 202*d*, and a transfer drum 201. Further, the registration device 107 has a similar configuration of FIG. 5, and thereby an explanation is omitted. Such image forming apparatus has a similar effect of image forming apparatus of FIG. 5.

Seventh Example Embodiment

Figure 8:
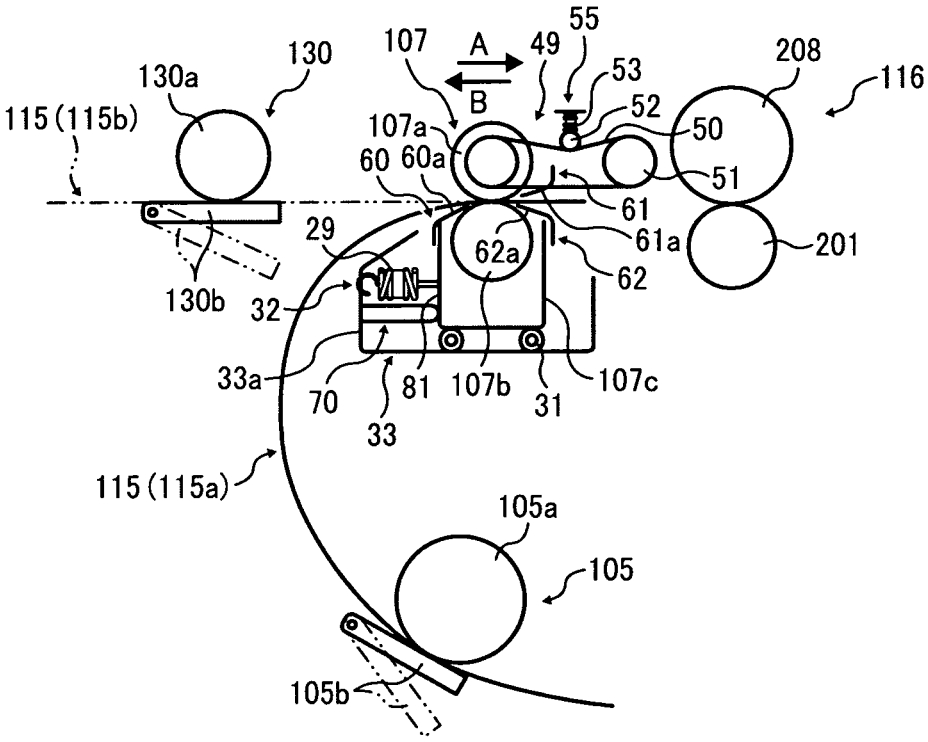
FIG. 8 shows an expanded view of a transportation system of an image forming apparatus according to a seventh example embodiment.

FIG. 8 shows a monochrome machine using the above-described configuration, and the registration device 107 has a similar configuration of FIG. 5. Such image forming apparatus has the similar effect of image forming apparatus of FIG. 5.

The above-described image forming apparatuses of example embodiments may be copiers using electrophotography, laser beam printers, facsimile machines, or the like. Although the biasing device 32 employs a coil spring in the above described example embodiments, other elastic members can be used. Further, if the registration device 107 can be moved to decrease the speed difference when a tension occurs to the transfer material 115, the biasing device 32 can be disposed at a downstream from the registration device 107.

In the above-described image forming apparatuses, the strain on the transfer material between module units such as between a registration device and a transfer device can be reduced, by which color misalignment and jitter on image can be reduced. Furthermore, because such configuration can be devised as a purely mechanical configuration, which can omit a detector or a controller, the cost of apparatus can be reduced. Further, slipping of transfer material (e.g., sheet) during a transportation can be reduced. Further, the transfer material transportation device may be an endless belt, which is a simplified configuration, and such configuration can reduce cost of apparatus.

By setting relations of Fbp>Fp, Fbd>Fp, Fr>Fp, a transfer material can be reliably transported, and an image forming operation can be conducted with high precision. Further, if the registration device can be moved to a position in an upstream of transport direction and "Fp=Fs+Fm" is set, the transportation speed difference can be suppressed, in particular, prevented. With such configuration, image quality degradation caused by the strain on the transfer material can be reliably prevented.

When a transfer material enters the registration device, the sheet transportation member in the sheet feeder can be separated from the transfer material, by which the of strain on the sheet between the registration device and sheet feeder can be reliably prevented, by which image quality degradation caused by the strain on the transfer material can be reliably prevented.

If the driver to drive the registration device is integrally configured with the registration device, a simpler configuration can be devised, and a cost of apparatus can be reduced.

If the transportation assisting and the separator are disposed, the transfer material can be reliably fed to the registration device, and the transfer material can be fed out reliably from the registration device, by which problems such as wrinkles on a fused sheet and/or image scratch, transportation sheet jamming (transportation failure) caused by fluctuation in transportation performance of the transfer material, which may occur by moving the registration device, can be suppressed, in particular, prevented.

The stopper, stop member, or regulating member to stop the registration device at a given stop position after separating the transfer material from the registration device can be disposed. By disposing the stopper, the registration device can be stopped at a stop position, and the registration device can be returned to a default position, and thereby transportation performance of transfer material can be enhanced.

In the above described example embodiments, the strain on the transfer material such as sheet, paper, or the like between a registration device and a transfer device can be effectively reduced to a given allowable level in an image forming apparatus by employing the above described biasing device and the registration device moveably disposed in the image forming apparatus.

Numerous additional modifications and variations are possible in light of the above teachings. It is therefore to be understood that within the scope of the appended claims, the disclosure of the present invention may be practiced otherwise than as specifically described herein. For example, elements and/or features of different examples and illustrative embodiments may be combined each other and/or substituted for each other within the scope of this disclosure and appended claims.

What is claimed is:

1. An image forming apparatus, comprising:

a transfer material transportation device to transport a transfer material;

a transfer device to transfer a toner image to the transfer material transported by the transfer material transportation device;

a fusing device, disposed after the transfer device, to fuse a toner image on the transfer material transported by the transfer material transportation device;

a registration device, disposed before the transfer device, to feed the transfer material, supplied from a sheet feeder, in a feeding direction to the transfer device; and a biasing device, disposed for the registration device, to regulate movement of the registration device to decrease a speed difference between a transfer material transport speed generated by the transfer device and a transfer material transport speed generated by the registration device, wherein the regulated movement of the registration device by the biasing device is in a downstream direction of the feeding direction of the transfer material.

2. The image forming apparatus of claim 1, wherein the transfer material transportation device is an endless belt.

3. The image forming apparatus of claim 1, wherein no slip occurs between the transfer material transportation device and the transfer material, between the transfer material transportation device and a driver to drive the transfer material transportation device, and between the registration device and the transfer material during image formation on the transfer material.

4. The image forming apparatus of claim 1, wherein when a biasing force of the biasing device is Fs, a force occurring to a moveable member of the registration device is Frm, the registration device is moved when a relations of $Fp>Fs+Frm$ occurs, where Fp is a tension occurring to the transfer material.

5. The image forming apparatus of claim 1, further comprising the sheet feeder, the sheet feeder having a sheet transport member, wherein, after the transfer material enters the registration device, the sheet transport member separates from the transfer material.

6. The image forming apparatus of claim 1, further comprising a driver to drive the registration device, combined with the registration device and configured as a single integrated unit.

7. The image forming apparatus of claim 1, further comprising:

a transportation assisting unit, disposed upstream from the registration device in a transport direction of transport of the transfer material, to assist a transportation of the transfer material; and a separator, disposed downstream from the registration device in the transport direction, to separate the transfer material from the registration device, wherein the transportation assisting unit and the separator are integrated into the registration device as a single unit.

8. The image forming apparatus of claim 1, further comprising a stopper to stop the registration device at a given stop position after separating the transfer material from the registration device.

9. The image forming apparatus according to claim 1, wherein the biasing device is a coil spring.

10. The image forming apparatus according to claim 9, wherein the biasing device is connected to the registration device and the biasing device extends in the downstream direction.

11. The image forming apparatus according to claim 1, wherein the registration device is configured to move in the downstream direction based on the speed difference between the transfer material transport speed generated by the transfer device and the transfer material transport speed generated by the registration device.

12. The image forming apparatus according to claim 11, wherein the biasing device is configured to move the registration device in an upstream direction based on the speed difference.

13. The image forming apparatus according to claim 1, wherein the biasing device includes a roller connected to the registration device.

* * * * *